US007584788B2

(12) United States Patent
Baron et al.

(10) Patent No.: US 7,584,788 B2
(45) Date of Patent: Sep. 8, 2009

(54) CONTROL METHOD FOR DOWNHOLE STEERING TOOL

(75) Inventors: Emilio Baron, Cypress, TX (US); Stephen Jones, Cypress, TX (US)

(73) Assignee: Smith International Inc., Houston, TX (US)

( * ) Notice: Subject to any disclaimer, the term of this patent is extended or adjusted under 35 U.S.C. 154(b) by 42 days.

(21) Appl. No.: 11/805,171

(22) Filed: May 22, 2007

(65) Prior Publication Data

US 2007/0221375 A1 Sep. 27, 2007

Related U.S. Application Data

(63) Continuation of application No. 10/862,739, filed on Jun. 7, 2004, now Pat. No. 7,243,719.

(51) Int. Cl.
*E21B 47/022* (2006.01)
*E21B 44/00* (2006.01)
*E21B 7/04* (2006.01)

(52) U.S. Cl. ..... 166/255.2; 175/26; 175/45; 175/61; 702/9

(58) Field of Classification Search ..... 166/255.2; 175/45, 61, 26; 702/6, 9; 340/853.8, 853.1, 340/856.3; 33/304, 308, 310, 313, 321; 73/152.03, 73/152.45, 152.46
See application file for complete search history.

(56) References Cited

U.S. PATENT DOCUMENTS 3,853,185 A 12/1974 Dahl et al.
4,072,200 A * 2/1978 Morris et al. ..... 175/45
4,361,192 A 11/1982 Trowsdale
4,399,692 A 8/1983 Hulsing, II et al.
4,433,491 A 2/1984 Ott et al.
4,747,303 A * 5/1988 Fontenot ..... 73/152.03
5,163,521 A * 11/1992 Pustanyk et al. ..... 175/40
5,359,059 A 10/1994 Iwasaki et al.

(Continued)

FOREIGN PATENT DOCUMENTS

GB 2398638 A 8/2004
GB 2398879 A 9/2004
GB 2402746 A 12/2004
WO WO-00/11316 3/2000

OTHER PUBLICATIONS

Schlumberger Oilfield Glossary; definition for survey; http://www.glossary.oilfield.slb.com/Display.cfm?Term=survey; Jan 12, 2008.*

(Continued)

*Primary Examiner*—Kenneth Thompson

(57) ABSTRACT

A method for determining a rate of change of longitudinal direction of a subterranean borehole includes positioning a downhole tool in a borehole, the tool including first and second longitudinally spaced surveying devices disposed thereon. The method further includes causing the surveying devices to measure longitudinal directions of the borehole at first and second longitudinal positions and processing the longitudinal directions of the borehole to determine the rate of change of longitudinal direction of the borehole between the first and second positions. The method may further include processing the measured rate of change of longitudinal direction of the borehole and a predetermined rate of change of longitudinal direction to control the direction of drilling of the subterranean borehole. Exemplary embodiments of this invention tend to minimize the need for communication between a drilling operator and the bottom hole assembly, thereby advantageously preserving downhole communication bandwidth.

14 Claims, 3 Drawing Sheets

U.S. PATENT DOCUMENTS

| | | | | |
|---|---|---|---|---|
| 5,435,069 | A * | 7/1995 | Nicholson | 33/304 |
| 5,603,386 | A | 2/1997 | Webster | |
| 5,646,611 | A | 7/1997 | Dailey et al. | |
| 5,667,023 | A | 9/1997 | Harrell et al. | |
| 5,899,958 | A * | 5/1999 | Dowell et al. | 702/6 |
| 6,213,226 | B1 | 4/2001 | Eppink et al. | |
| 6,257,356 | B1 * | 7/2001 | Wassell | 175/61 |
| 6,321,456 | B1 | 11/2001 | McElhinnney | |
| 6,347,282 | B2 | 2/2002 | Estes et al. | |
| 6,405,808 | B1 | 6/2002 | Edwards et al. | |
| 6,427,783 | B2 | 8/2002 | Krueger et al. | |
| 6,438,495 | B1 | 8/2002 | Chau et al. | |
| 6,467,314 | B1 | 10/2002 | Boucher | |
| 6,480,119 | B1 | 11/2002 | McElhinney | |
| 6,513,606 | B1 | 2/2003 | Krueger | |
| 6,668,465 | B2 * | 12/2003 | Noureldin et al. | 33/304 |
| 6,882,937 | B2 * | 4/2005 | McElhinney | 702/9 |
| 6,918,186 | B2 * | 7/2005 | Ash et al. | 33/313 |
| 6,937,023 | B2 * | 8/2005 | McElhinney | 324/347 |
| 6,944,545 | B2 | 9/2005 | Close et al. | |
| 6,985,814 | B2 * | 1/2006 | McElhinney | 702/7 |
| 7,069,780 | B2 | 7/2006 | Ander | |
| 2003/0037963 | A1 | 2/2003 | Barr et al. | |
| 2003/0146022 | A1 | 8/2003 | Krueger | |
| 2004/0050590 | A1 | 3/2004 | Pirovolou et al. | |
| 2004/0073369 | A1 | 4/2004 | McElhinney | |
| 2005/0268476 | A1 | 12/2005 | Illfelder | |

OTHER PUBLICATIONS

Schlumberger Oilfield Glossary; definition for log; http://www.glossary.oilfield.slb.com/Display.cfm?Term=log; Jan. 12, 2008.*

Schuh, F. J., Trajectory Equations for Constant Tool Face Angle Deflections, IADC/SPE 23853, p. 111-123, (1992).

Sawaryn, S. J. and Thorogood, J. L., A Compendium of Directional Calculations Based on the Minimum Curvature Method, SPE 84246 (2003).

* cited by examiner

CONTROL METHOD FOR DOWNHOLE STEERING TOOL

RELATED APPLICATIONS

This application is a continuation of co-pending, commonly-assigned U.S. patent application Ser. No. 10/862,739 entitled CONTROL METHOD FOR DOWNHOLE STEERING TOOL, filed Jun. 7, 2004.

FIELD OF THE INVENTION

The present invention relates generally to directional drilling applications. More particularly, this invention relates to a control system and method for controlling the direction of drilling.

BACKGROUND OF THE INVENTION

In oil and gas exploration, it is common for drilling operations to include drilling deviated (non vertical) and even horizontal boreholes. Such boreholes may include relatively complex profiles, including, for example, vertical, tangential, and horizontal sections as well as one or more builds, turns, and/or doglegs between such sections. Recent applications often utilize steering tools including a plurality of independently operable force application members (also referred to as blades or ribs) to apply force on the borehole wall during drilling to maintain the drill bit along a prescribed path and to alter the drilling direction. Such force application members are typically disposed on the outer periphery of the drilling assembly body or on a non-rotating sleeve disposed around a rotating drive shaft. Exemplary steering tools are disclosed by Webster in U.S. Pat. No. 5,603,386 and Krueger et al. in U.S. Pat. No. 6,427,783.

In order to control the drilling along a predetermined profile, such steering tools are typically controlled from the surface and/or by a downhole controller. For example, in known systems, the direction of drilling (inclination and azimuth) may be determined downhole using conventional MWD surveying techniques (e.g., using accelerometers, magnetometers, and/or gyroscopes). The measured direction may be transmitted (e.g., via mud pulse telemetry) to a drilling operator who then compares the measured direction to a desired direction and transmits appropriate control signals back to the steering tool. Alternatively, the measured direction may be compared with a desired direction and appropriate control signals determined, for example, using a downhole computer. In curved sections of the borehole (e.g., builds, turns, or doglegs) the rate of penetration and/or the total vertical depth of the borehole is required to determine the desired direction. Such parameters are typically determined at the surface and transmitted downhole.

While such procedures have been utilized successfully in various drilling operations, both tend to be limited by the typically scarce downhole communication bandwidth (e.g., mud pulse telemetry bandwidth) available in drilling operations. Telemetry bandwidth constraints tend to reduce the frequency of survey data available for control of the steering tool. For example, in a typical drilling application utilizing conventional mud pulse telemetry, several minutes may be required to record each survey point and communicate with the surface. Such time delays render sustained control difficult at best and may lead to more tortuous borehole profiles that sometimes require costly and time consuming reaming operations.

Barr et al., in U.S. Patent Application Publication 2003/0037963, discloses a method for measuring the curvature of a borehole utilizing a downhole structure including at least three longitudinally spaced distance sensors. The distance sensors are utilized to measure a distance between the structure and the borehole wall. The downhole structure typically further includes strain gauges deployed thereon to determine the curvature of the downhole structure when deployed in the borehole. The curvature of the borehole is then calculated from the curvature of the downhole structure and the distances between the structure and the borehole wall. The curvature of the borehole may then be used as an input component of a bias signal for controlling operation of a downhole bias unit in a directional drilling assembly.

The approach disclosed by Barr et al., while potentially serviceable in some drilling applications, suggests several drawbacks. First, as described above, Barr et al., disclose a complex apparatus for determining borehole curvature, the apparatus including at least three distance sensors and multiple strain gauges mounted on a structure, which is further mounted in a drill collar. Such complexity tends to increase both fabrication and maintenance costs and inherently reduces reliability (especially in the demanding downhole environment). Furthermore, the magnitude of the curvature is inadequate to fully define a change in the longitudinal direction of a borehole. As such, Barr et al. disclose a device having even greater complexity, including a roll stabilized platform suspended in the structure and a plurality of magnets for determining its orientation relative to the structure. Such additional structure is intended to enable the tool to determine both the curvature and tool face of the borehole.

Moreover, since the method disclosed by Barr et al. depends on distance measurements between the borehole wall and a downhole tool, the accuracy of the curvature measurements may be significantly compromised in boreholes having a rough surface (e.g., in formations in which there is appreciable washout during drilling). Another potential source of error is related to the length of the structure to which the distance sensors are mounted. If the structure is relatively short, then the curvature of the borehole is measured along an equally short section thereof and hence subject to error (e.g., via local borehole washout or turtuosity). On the other hand, if the structure is relatively long, then measurement of its curvature becomes complex (e.g., possibly requiring numerous strain gauges) and hence prone to error.

Therefore, there exists a need for an improved method and system for controlling downhole steering tools that address one or more of the shortcomings described above.

SUMMARY OF THE INVENTION

Exemplary embodiments of the present invention are intended to address the above described need for an improved system and method for controlling downhole steering tools. Referring briefly to the accompanying figures, aspects of this invention include a system and method for determining a rate of change of the longitudinal direction (RCLD) of a borehole. Such a rate of change of direction may be determined, for example, by acquiring survey readings at first and second longitudinal positions in the borehole. In one embodiment, a downhole tool includes first and second survey sensor sets deployed at corresponding first and second longitudinal positions thereon. Such a downhole tool may further include a controller that utilizes the measured RCLD of the borehole to steer subsequent drilling of the borehole along a predetermined path.

Exemplary embodiments of the present invention may advantageously provide several technical advantages. For example, exemplary methods according to this invention enable the RCLD of the borehole to be determined independent of the rate of penetration or total vertical depth of the borehole. As such, embodiments of this invention tend to minimize the need for communication between a drilling operator and the bottom hole assembly, thereby advantageously preserving downhole communication bandwidth. Furthermore, embodiments of this invention enable control data to be acquired at significantly increased frequency, thereby improving the control of the drilling process. Such improved control may reduce tortuosity of the borehole and may therefore tend to minimize (or even eliminate) the need for expensive reaming operations.

In one aspect the present invention includes a method for determining a rate of change of longitudinal direction of a subterranean borehole. The method includes (1) providing a downhole tool including first and second surveying devices disposed at corresponding first and second longitudinal positions in the borehole, the surveying devices being freely disposed to rotate with respect to one another about a longitudinal axis of the borehole, (2) causing the first and second surveying devices to measure a longitudinal direction of the borehole at the corresponding first and second positions, and (3) processing the longitudinal directions of the borehole at the first and second positions to determine the rate of change of longitudinal direction of the borehole between the first and second positions. One alternative variation of this aspect further includes, by way of example, processing the measured rate of change of longitudinal direction of the borehole and a predetermined rate of change of longitudinal direction to control the direction of drilling of the subterranean borehole.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

It will be appreciated that aspects of this invention enable the rate of change of the longitudinal direction (RCLD) of a borehole to be measured. It will be understood by those of ordinary skill in the art that the RCLD of a borehole is typically fully defined in one of two ways (although numerous others are possible). First, the RCLD of a borehole may be quantified by specifying the build rate and the turn rate of the borehole. Where used in this disclosure the term "build rate" is used to refer to the vertical component of the curvature of the borehole (i.e., a change in the inclination of the borehole). The term "turn rate" is used to refer to the horizontal component of the curvature of the borehole (i.e., a change in the azimuth of the borehole). The RCLD of a borehole may also be quantified by specifying the dogleg severity and the tool face of the borehole. Where used in this disclosure the term "dogleg severity" refers to the curvature of the borehole (i.e., the severity or degree of the curve of the borehole) and the term "tool face" refers to the angular direction to which the borehole is turning (e.g., relative to the high side when looking down the borehole). For example, a tool face of 0 degrees indicates a borehole that is turning upwards (i.e., building), while a tool face of 90 degrees indicates a borehole that is turning to the right. A tool face of 45 degrees indicates a borehole that is turning upwards and to the right (i.e., simultaneously building and turning to the right).

Figure 1:
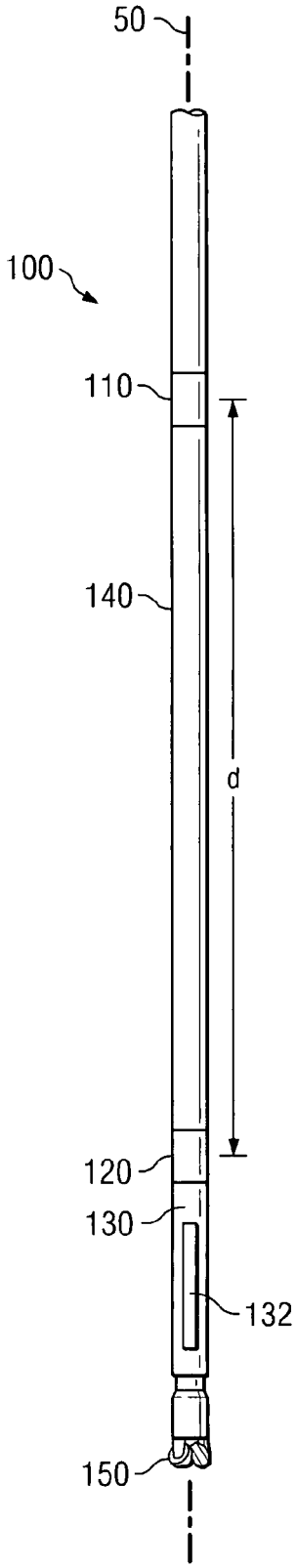
FIG. 1 depicts an exemplary embodiment of a downhole tool according to the present invention including both upper and lower sensor sets and a steering tool.
Figure 2:
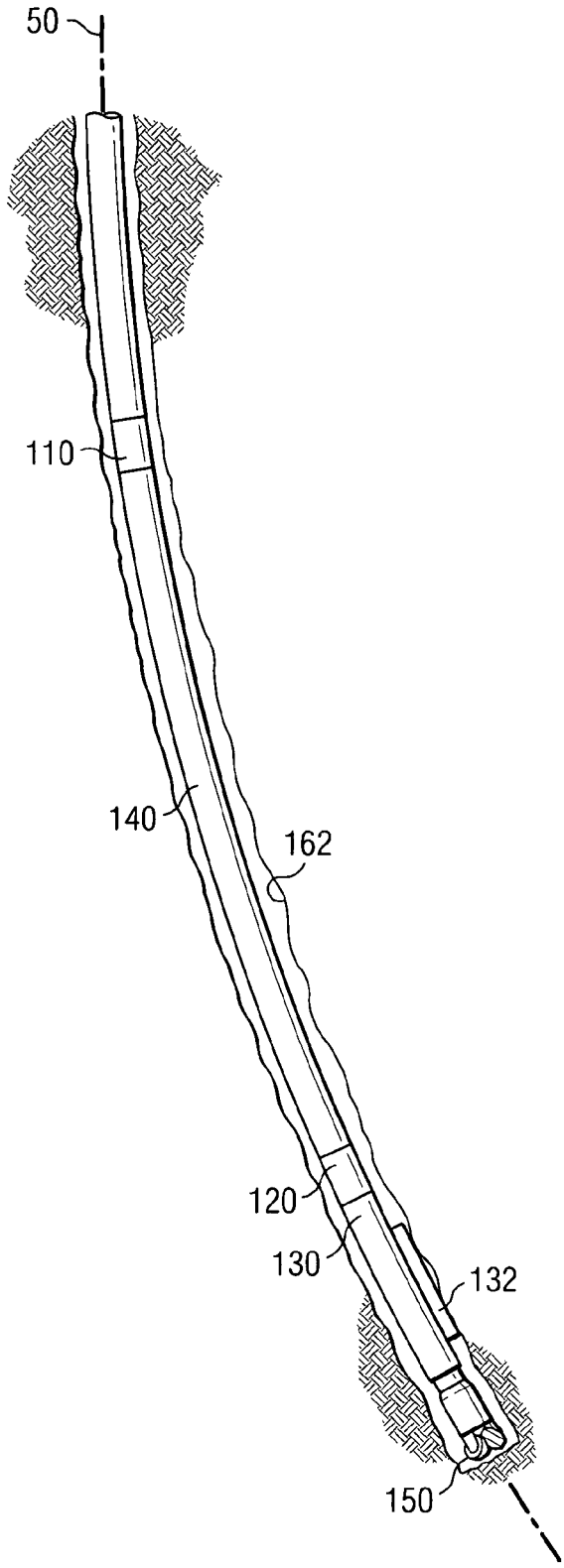
FIG. 2 depicts the downhole tool of FIG. 1 deployed in a deviated borehole.

Referring now to FIGS. 1 and 2, one exemplary embodiment of a downhole tool 100 according to the present invention is illustrated. In FIG. 1, downhole tool 100 is illustrated as a directional drilling tool including upper 110 and lower 120 sensor sets, a downhole steering tool 130, and a drill bit assembly 150. In the embodiment shown, steering tool 130 includes a plurality of stabilizer blades 132 (e.g., three) for engaging the wall of a borehole. The radial positions of each of the individual stabilizer blades 132 (or alternatively the force or pressure applied to the blades 132) may be individually controlled by a suitable controller (not shown). One or more of the force application members 132 may be moved in a radial direction, e.g., using electrical or mechanical devices (not shown), to apply force on the borehole wall in order to steer the drill bit 150 outward from the longitudinal axis of the borehole. It will be appreciated that this invention is not limited to any particular type of steering tool. Suitable steering tools may include substantially any known control scheme to control the direction of drilling, for example, by controlling the radial position of (or alternatively the force or pressure applied to) various stabilizer blades 132. Further, embodiments of this invention may utilize both two-dimensional and three-dimensional rotary steerable tools. FIG. 1 illustrates that the upper 110 and lower 120 sensor sets are disposed at a known longitudinal spacing 'd' in the downhole tool 100. The spacing 'd' may be, for example, in a range of from about 2 to about 30 meters (i.e., from about 6 to about 100 feet) or more, but the invention is not limited in this regard. Each sensor set (110 and 120) includes one or more surveying devices such as accelerometers, magnetometers, or gyroscopes. In one preferred embodiment, each sensor set (110 and 120) includes three mutually perpendicular accelerometers, with at least one accelerometer in each set having a known orientation with respect to the borehole.

With continued reference to FIGS. 1 and 2, sensor sets 110 and 120 are connected by a structure 140 that permits bending along its longitudinal axis 50 (as shown in FIG. 2 in which the downhole tool 100 is shown deployed in a deviated borehole 162). In certain embodiments, structure 140 may substantially resist rotation along the longitudinal axis 50 between the upper 110 and lower 120 sensor sets, however, the invention is not limited in this regard as described in more detail below. Structure 140 may include substantially any suitable deflectable tube, such as a portion of a drill string. Structure 140 may also include one or more MWD or LWD tools, such as acoustic logging tools, neutron density tools, resistivity tools, formation sampling tools, and the like. It will also be appreciated that while sensor set 120 is shown distinct from steering tool 130, it may be incorporated into the steering tool 130, e.g., in a non-rotating sleeve portion thereof.

Figure 3:
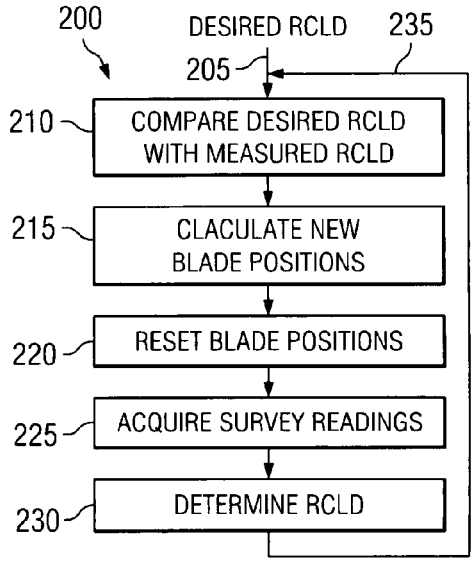
FIG. 3 depicts a control loop diagram illustrating an exemplary method of this invention.

With reference now to FIG. 3, and continued reference to FIG. 2, an exemplary control method 200 according to this invention may be utilized to control the direction of drilling. As shown at 225 of FIG. 3, sensor sets 110 and 120 may be utilized to determine the local longitudinal directions of the borehole (e.g., the inclination and/or the azimuth values). As described in more detail below, and as shown at 230, such local directions may be processed downhole to determine the RCLD of the borehole (e.g., the build and turn rates of the borehole or the dogleg severity and tool face of the borehole). At 210*a* controller (not shown) compares the measured RCLD determined at 230 with a desired RCLD 205 (e.g., preprogrammed into the controller or received via communication with the surface). The comparison may, for example, include subtracting the measured build and turn rate values from the desired build and turn rate values (or alternatively subtracting the measured dogleg severity and tool face values from the desired values). The output may then be utilized to calculate new blade 132 positions (if necessary) at 215. The blades 132 may then be reset to such new positions (also if necessary) at 220 prior to acquiring new survey readings at 225 and repeating the loop. It will be appreciated that control method 200 provides for (but does not require) closed loop control of the drilling direction. It will be seen from FIG. 3 that control over the drilling direction, as described above, relies only on the measured and required RCLD values (e.g., turn and build rates or dogleg severity and tool face).

Figure 4:
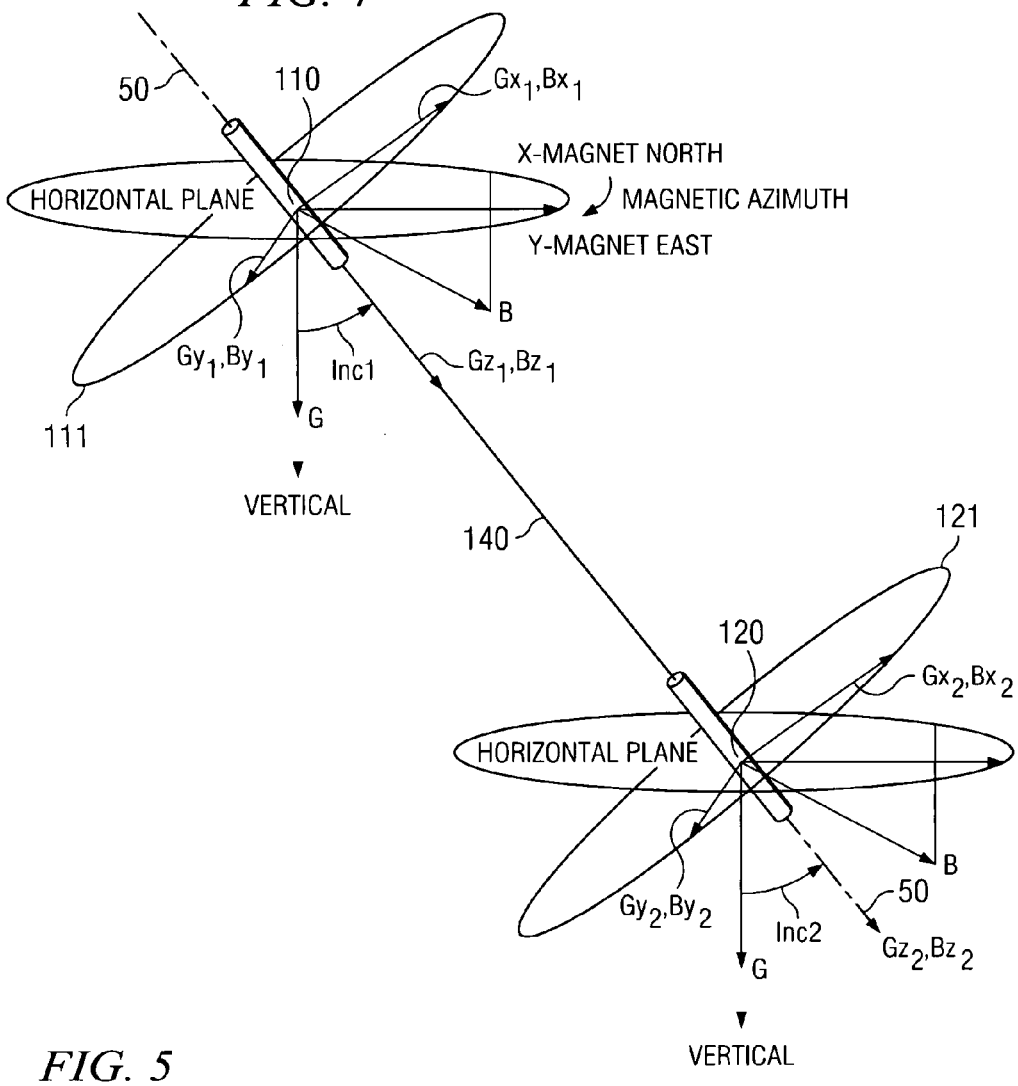
FIG. 4 is a diagrammatic representation of a portion of the downhole tool of FIG. 1 showing unit magnetic field and gravity vectors.

Referring now to FIG. 4, a diagrammatic representation of a portion of one exemplary embodiment of the downhole tool of FIG. 1 is illustrated. In the particular embodiment shown on FIG. 4, each sensor set includes three mutually perpendicular gravity sensors, one of which is oriented substantially parallel with a longitudinal axis of the borehole and measures gravity vectors denoted as Gz1 and Gz2 for the upper and lower sensor sets, respectively. Likewise, each sensor set also includes three mutually perpendicular magnetic field sensors, one of which is oriented substantially parallel with a longitudinal axis of the borehole and measures magnetic field vectors denoted as Bz1 and Bz2 for the upper and lower sensor sets, respectively. Each set of gravity and magnetic field sensors may be considered as determining a plane (Gx, Bx and Gy, By) and pole (Gz, Bz) as shown.

The borehole inclination values (Inc1 and Inc2) may be determined at the upper 110 and lower 120 sensor sets, respectively, for example, as follows:

$$Inc1 = \arctan\left(\frac{\sqrt{Gx1^2 + Gy1^2}}{Gz1}\right) \quad \text{Equation 1}$$

$$Inc2 = \arctan\left(\frac{\sqrt{Gx2^2 + Gy^2}}{Gz2}\right) \quad \text{Equation 2}$$

where G represents a gravity sensor measurement (such as, for example, a gravity vector measurement), x, y, and z refer to alignment along the x, y, and z axes, respectively, and 1 and 2 refer to the upper 110 and lower 120 sensor sets, respectively. Thus, for example, Gx1 is a gravity sensor measurement aligned along the x-axis taken with the upper sensor set 110.

Borehole azimuth values (Azi1 and Azi2) may be determined at the upper 110 and lower 120 sensor sets, respectively, for example, as follows:

$$Azi1 = \arctan\left(\frac{(Gx1 * By1 - Gy1 * Bx1) * \sqrt{Gx1^2 + Gy1^2 + Gz1^2}}{Bz1 * (Gx1^2 + Gy1^2) - Gz1 * (Gx1 * Bx1 - Gy1 * By1)}\right) \quad \text{Equation 3}$$

$$Azi2 = \arctan\left(\frac{(Gx2 * By2 - Gy2 * Bx2) * \sqrt{Gx2^2 + Gy2^2 + Gz2^2}}{Bz2 * (Gx2^2 + Gy2^2) - Gz2 * (Gx2 * Bx2 - Gy2 * By2)}\right) \quad \text{Equation 4}$$

where G represents a gravity sensor measurement, B represents a magnetic field sensor measurement, x, y, and z refer to alignment along the x, y, and z axes, respectively, and 1 and 2 refer to the upper 110 and lower 120 sensor sets, respectively. Thus, for example, Gx1 and Bx1 represent gravity and magnetic field sensor measurements aligned along the x-axis taken with the upper sensor set 110. The artisan of ordinary skill will readily recognize that the gravity and magnetic field measurements may be represented in unit vector form, and hence, Gx1, Bx1, Gy1, By1, etc., represent directional components thereof.

The build and turn rates for the borehole may be determined from inclination and azimuth values, respectively, at the first and second sensor sets. Such inclination and azimuth values may be utilized in conjunction with substantially any known approach, such as minimum curvature, constant curvature, radius of curvature, average angle, and balanced tangential techniques, to determine the build and turn rates. Using one such technique, the build and turn rates may be expressed mathematically, for example, as follows:

$$BuildRate = \frac{Inc2 - Inc1}{d} \quad \text{Equation 5}$$

$$TurnRate = \frac{Azi2 - Azi1}{d} \quad \text{Equation 6}$$

where Inc1 and Inc2 represent the inclination values determined at the first and second sensor sets 110, 120, respectively (for example as determined according to Equations 1 and 2), Azi1 and Azi2 represent the azimuth values determined at the first and second sensor sets 110, 120, respectively (for example as determined according to Equations 3 and 4), and d represents the longitudinal distance between the first and second sensor sets 110, 120 (as shown in FIG. 1).

Alternatively (as described above), the RCLD may be expressed in terms of dogleg severity and tool face. For example, using known minimum curvature techniques, dogleg severity and tool face may be expressed as follows:

$$ToolFace = \arccos\left[\frac{\cos(\mathrm{Inc1})\cos(D) - \cos(Inc2)}{\sin(Inc1)\sin(D)}\right] \quad \text{Equation 7}$$

$$DogLeg = \frac{D}{d} \quad \text{Equation 8}$$

where:

$$D = \arccos\left[\frac{\cos(Azi2 - Azi1)\sin(Inc1)}{\sin(Inc2) + \cos(Inc1)\cos(Inc2}\right] \quad \text{Equation 9}$$

and where DogLeg represents the dogleg severity, ToolFace represents the tool face, Inc1 and Inc2 represent the inclination values determined at the first and second sensor sets 110, 120, respectively, Azi1 and Azi2 represent the azimuth values determined at the first and second sensor sets 110, 120, respectively, and d represents the longitudinal distance between the first and second sensor sets 110, 120.

As shown above in Equations 5 through 9, embodiments of this invention advantageously enable the build and turn rates (and therefore the RCLD) of the borehole to be determined directly, independent of the rate of penetration, total vertical depth, or other parameters that require communication with the surface. For example, if Inc1 and Inc2 are 57 and 56 degrees, respectively, and the distance between the first and second sensor sets is 33 feet, then Equation 5 gives a build rate of about 0.03 degrees per foot (also referred to as 3 degrees per 100 feet). Likewise, Equations 7 through 9 give a dogleg severity of about 0.03 degrees per foot at a tool face of zero degrees. It will be further appreciated by those of ordinary skill in the art that embodiments of this invention may be utilized in combination with substantially any known sag correction routines, in order to correct the RCLD values for sag of the downhole tool and/or portions of the drill string in the borehole.

Figure 5:
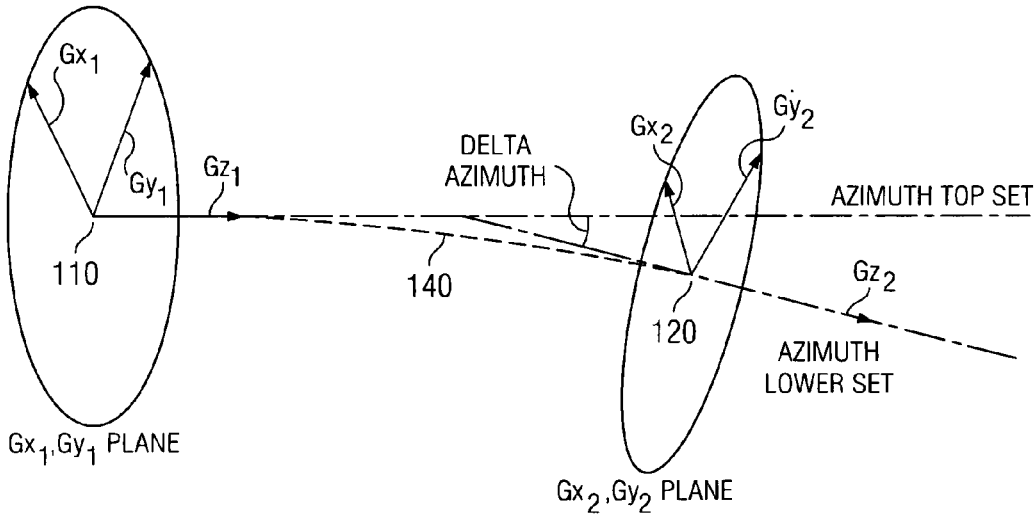
FIG. 5 is another diagrammatic representation of a portion of the downhole tool of FIG. 1 showing a change in azimuth between the upper and lower sensor sets.

With reference now to FIG. 5, the RCLD of the borehole may alternatively be determined independent of direct azimuthal measurements, such as via magnetic field sensors (magnetometers). In such alternative embodiments, the RCLD may be determined using only gravity sensors. The difference in the azimuth values between the first and second sensor sets 110, 120 may be determined from the gravity sensors, for example, as follows:

$$DeltaAzi = -\mathrm{Beta}\left[1 + \frac{Inc1}{Inc2}\right] \quad \text{Equation 10}$$

where DeltaAzi represents the difference in azimuth values between the first and second sensor sets 110, 120, Inc1 and Inc2 represent inclination values at the first and second sensor sets 110, 120, respectively (e.g., as given in Equations 1 and 2), and Beta is given as follows:

$$\mathrm{Beta} = \arctan\left(\frac{(Gx2 * Gy1 - Gy2 * Gx1) * \sqrt{Gx1^2 + Gy1^2 + Gz1^2}}{Gz2 * (Gx1^2 + Gy1^2) + Gz1 * (Gx2 * Gx1 + Gy2 * Gy1)}\right) \quad \text{Equation 11}$$

where Gx1, Gy1, Gz1, Gx2, Gy2, and Gz2 represent the gravity sensor measurements as described above. The turn rate may then be determined, for example, as follows:

$$TurnRate = \frac{DeltaAzi}{d} \quad \text{Equation 12}$$

where DeltaAzi is determined in Equation 10 and d represents the longitudinal distance between the first and second sensor sets 110, 120, as shown in FIG. 1. Alternatively, combining Equations 8 and 9, the dogleg severity may be expressed as follows:

$$DogLeg = \frac{\arccos[\cos(DeltaAzi)\sin(Inc1)\sin(Inc2) + \cos(Inc1)\cos(Inc2)]}{d} \quad \text{Equation 10}$$

where DeltaAzi, Inc1, Inc2, and d are as defined above.

As described above with respect to FIGS. 1 and 2, exemplary embodiments of this invention include a downhole tool having first and second sensor sets 110, 120 deployed at a known longitudinal spacing thereon. However, it will be appreciated that other embodiments of this invention may include substantially any number of sensor sets. For example, downhole tools including three or more sensor sets deployed at a known longitudinal spacing may also be advantageously utilized. In such embodiments the RCLD of a borehole may be determined in a manner similar to that described above. It will also be appreciated that downhole tools including three or more sensor sets may be advantageous for certain applications in that they generally provide increased accuracy and reliability (although with a trade off being increased costs).

Figure 6:
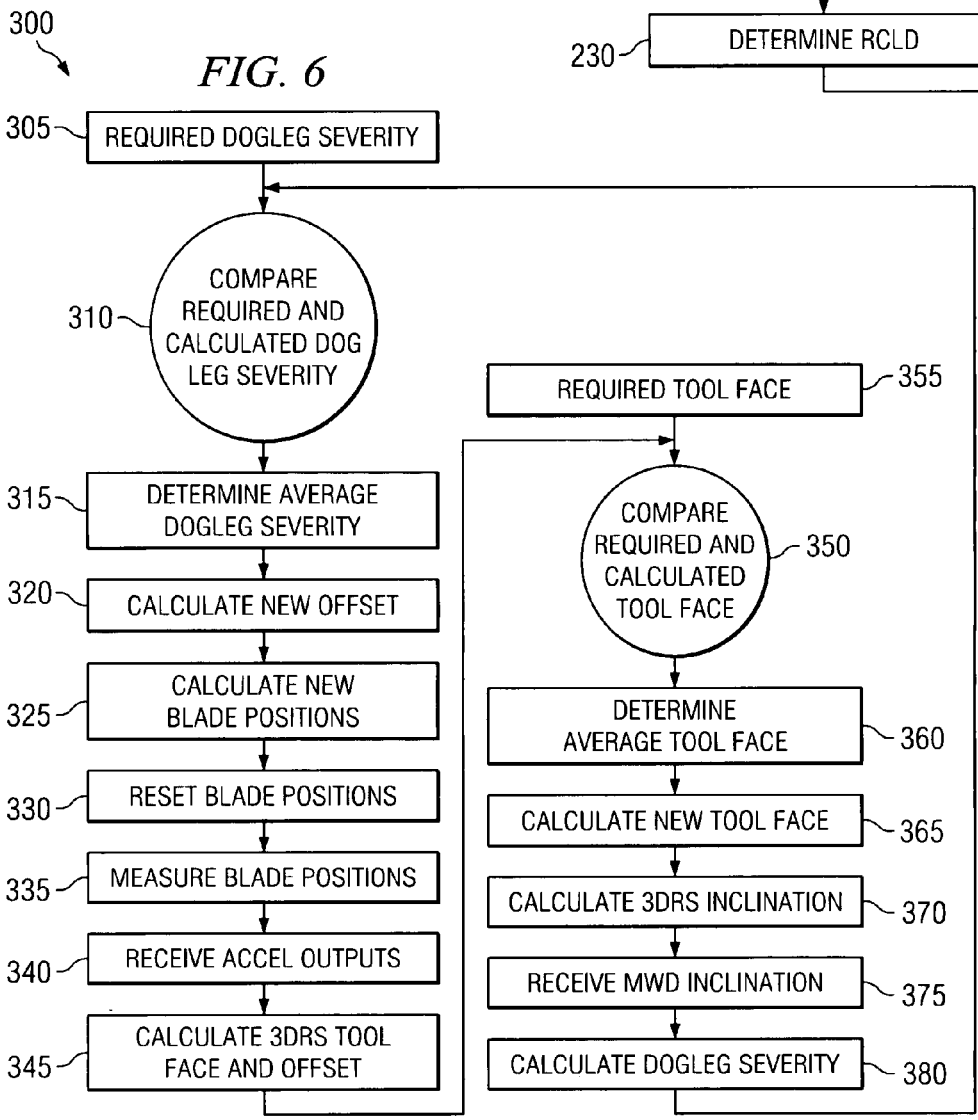
FIG. 6 depicts another control loop diagram illustrating an exemplary method of this invention.

With reference now to FIG. 6, an alternative embodiment of the control aspect of this invention is illustrated. Control method 300 on FIG. 6 is analogous to control method 200 on FIG. 3 in that it provides for (but does not require) closed loop control of the direction of drilling. As described above, the direction of drilling may be directly controlled by comparing measured and predetermined dogleg severity and tool face values. On FIG. 6, dogleg severity and tool face values are determined at 380 and 345, respectively, and compared to predetermined values at 310 and 350, respectively. Such comparisons may be utilized to determine new blade positions 325 for the steering tool and thus to control the direction of drilling.

With continued reference to FIG. 6, one exemplary embodiment of control method 300 is now described in more detail. At 310 a controller compares a measured dogleg severity (determined at 380 as described in more detail below) with a required dogleg severity 305 (e.g., preprogrammed into the controller or communicated to the controller from the surface). As also described above with respect to FIG. 3, the comparison may, for example, include subtracting the measured dogleg severity from the required dogleg severity. The difference between the measured 380 and required 305 dogleg severity values may be utilized to determine a new offset value for the steering tool at 320. In one exemplary embodiment, an offset value in 320 is determined such that the average dogleg severity calculated in 315 (e.g., along a predetermined section of the borehole) equals the required dogleg severity 305. In one embodiment, the offset determined in 320 is the radial distance between the longitudinal axis of the steering tool and the longitudinal axis of the borehole. Such an offset is related (e.g., proportionally) to the dogleg severity and may be utilized to calculate new blade positions as shown at 325. The blade positions may then be adjusted (if necessary) to the newly calculated positions at 330.

In the exemplary embodiment shown, the lower sensor set may be deployed in the substantially non-rotating outer sleeve of a steering tool. As such, the upper and lower sensor sets may rotate relative to one another about the longitudinal axis of the downhole tool (e.g., axis 50 in FIG. 1). In such configurations it may be advantageous to determine one of the two control parameters (e.g., tool face) independent of the upper sensor set (e.g., sensor set 110 in FIG. 1) as shown in the exemplary embodiment of control method 300 on FIG. 6. The position (e.g., displacement from the reset position) of the blades may be determined at 335 and utilized to determine a local borehole diameter and the relative position of the steering tool in the borehole. Accelerometer inputs from the lower sensor set may then be received at 340 and utilized to determine the tool face of the steering tool 345 (and therefore the borehole).

With continued reference to FIG. 6, a controller compares 350 the measured tool face (determined at 345) with a required tool face 355 (e.g., preprogrammed into the controller or received via communication with the surface). The difference between the measured 345 and required 355 tool face values may be utilized to determine a new tool face value for the steering tool at 365. In one exemplary embodiment, the new tool face value at 365 is determined such that the average tool face calculated at 360 (e.g., along a predetermined section of the borehole) equals the required dogleg severity 355. At 370 an inclination value may be determined at the steering tool from the accelerometer readings received at 340. An inclination value may also be received from an upper sensor set (e.g., from an MWD tool) at 375. Such inclination values and the tool face calculated at 345 may be utilized to determine a dogleg severity at 380. For example, in one embodiment, the tool face and inclination values may be substituted into Equation 7, which may then, along with Equation 8, be solved for the dogleg severity of the borehole. Returning to 310 the controller may then compare the measured dogleg severity 380 to the required value 305 and repeat the loop.

It will be appreciated that embodiments of this invention may be utilized to control the direction of drilling over multiple sections of a well (or even, for example, along an entire well plan). This may be accomplished, for example, by dividing a well plan into two or more sections, each having a distinct RCLD. Such a well plan would typically further include predetermined inflection points (also referred to as targets) between each section. The targets may be defined by substantially any method known in the art, such as, for example, by predetermined inclination, azimuth, and/or measured depth values. In one exemplary embodiment, a substantially J-shaped well plan may be separated into three sections with a first target between the first and second sections and a second target between the second and third sections. For example, a substantially straight first section (e.g., with an inclination of about 30 degrees) may be followed by a second section that simultaneously builds and turns (e.g., at a tool face angle of about 45 degrees and dogleg severity of about 5 degrees per 100 feet) to a substantially horizontal third section (e.g., having an inclination of about 90 degrees). Such a J-shaped well plan is disclosed by way of illustration only. It will be appreciated that this invention is not limited to any number of well sections and/or intermediary targets.

During drilling of a multi-section borehole, the drilling direction may be controlled in each section, for example, as described above with respect to FIG. 6. Upon reaching a target, the controller may be reprogrammed to steer subsequent drilling in another direction (e.g., a predetermined direction required to reach the next target). The controller may be reprogrammed in substantially any manner. For example, a new RCLD (e.g., tool face and dogleg severity) may be transmitted from the surface to the controller. Alternatively, the controller may be preprogrammed to include a predetermined RCLD for each section of the well plan. In such an alternative embodiment the controller may be instructed to increment to the next RCLD. Subsequent drilling may proceed in this manner through substantially any number of sections until, if so desired, the borehole is complete. It will also be appreciated that the controller may be programmed to automatically increment to another RCLD upon reaching a predetermined target. For example, upon achieving certain predetermined inclination and/or azimuth values, the controller may automatically increment to the next RCLD. In this manner, an entire borehole may potentially be drilled according to a predetermined well plan without intervention from the surface. Surface monitoring may then be by way of supervision of the downhole-controlled drilling. Alternatively, directional drilling can be undertaken, if desired, without communication with the surface.

It will be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

We claim:

1. A method for determining a a curvature of a subterranean borehole, the method comprising:

(a) providing a downhole tool in a drill string, the downhole tool including first and second surveying devices disposed at corresponding first and second longitudinal positions in the borehole, the first and second surveying devices deployed on corresponding first and second body portions of the downhole tool, wherein the first and second body portions are configured to rotate substantially freely with respect to one another about a longitudinal axis of the downhole tool during drilling;

(b) causing the first and second surveying devices to measure longitudinal directions of the borehole at the corresponding first and second positions; and (c) processing the longitudinal directions of the borehole at the first and second positions to determine the curvature of the borehole between the first and second positions.

2. The method of claim 1, wherein the curvature of the borehole includes at least one of the group consisting of:

(i) a build rate, (ii) a turn rate, and (iii) a dogleg severity and a tool face.

3. The method of claim 1, wherein: the first and second surveying devices each include a tri-axial accelerometer set including three mutually perpendicular accelerometers, one of which is fixed at a known angle relative to a longitudinal axis of the downhole tool.

4. The method of claim 1, wherein (b) further comprises determining inclination and azimuth values of the borehole at each of the first and second positions.

5. The method of claim 1, wherein the curvature of the borehole is determined in (c) according to a set of equations selected from the group consisting of:

$$BuildRate = \frac{Inc2 - Inc1}{d} \quad (1)$$

$$TurnRate = \frac{Azi2 - Azi1}{d};$$

$$BuildRate = \frac{Inc2 - Inc1}{d} \quad (2)$$

$$TurnRate = \frac{DeltaAzi}{d}; \text{ and}$$

$$ToolFace = \arccos\left[\frac{\cos(Inc1)\cos(D) - \cos(Inc2)}{\sin(Inc1)\sin(D)}\right] \quad (3)$$

$$DogLeg = \frac{D}{d};$$

wherein BuildRate represents a build rate of the subterranean borehole, TurnRate represents a turn rate of the subterranean borehole, Inc1 and Inc2 represent inclination values at the first and second positions, Azi1 and Azi2 represent azimuth values at the first and second positions, d represents a distance between the first and second positions, DeltaAzi represents a difference in azimuth between the first and second positions, ToolFace represents a tool face of the subterranean borehole, DogLeg represents a dogleg severity of the subterranean borehole, and D is given as follows:

$$D = \arccos\,[\cos(Azi2 - Azi1)\sin(Inc1)\sin(Inc2) + \cos(Inc1)\cos(Inc2)].$$

6. The method of claim 1, wherein the downhole tool comprises a steering tool, the second body portion being configured to rotate with the drill string, the first body portion comprising a plurality of force applications members each of which is configured to displace radially outward from the longitudinal axis and contact a borehole wall.

7. A method for controlling the direction of drilling a subterranean borehole, the method comprising:

(a) providing a string of tools including first and second surveying devices disposed at corresponding first and second longitudinal positions in the borehole, the first and second surveying devices deployed on corresponding first and second body portions of the downhole tool, wherein the first and second body portions are configured to rotate substantially freely with respect to one another about a longitudinal axis of the downhole tool during drilling, the string of tools further comprising a controller, the controller disposed to ordain a predetermined curvature of the subterranean borehole;

(b) causing the first and second surveying devices to measure longitudinal directions of the borehole at the corresponding first and second positions;

(c) processing the longitudinal directions of the borehole at the first and second positions to determine a curvature of the borehole between the first and second positions; and (d) processing the measured curvature of the borehole determined in (c) and the predetermined curvature ordained in (a) to control the direction of drilling of the subterranean borehole.

8. The method of claim 7, wherein (b) comprises determining inclination values at each of the first and second positions.

9. The method of claim 7, wherein the first downhole body comprises a substantially non-rotating outer sleeve of a steering tool, steering tool having a plurality of radially actuatable force application members.

10. The method of claim 9, wherein the steering tool comprises a three dimensional rotary steerable tool.

11. The method of claim 9, wherein the second downhole tool body portion comprises a measurement while drilling surveying tool.

12. The method of claim 9, wherein (d) further comprises controlling at least one of the group consisting of:

(1) the radial position of at least one of the plurality of force application members; and (2) a radial force applied by at least one of the plurality of force application members.

13. The method of claim 9, further comprising:

(e) repositioning the downhole tool to create a new locus for each of the first and second positions, and then repeating (b), (c), and (d);

(f) processing the measured rates of change of longitudinal direction determined in (c) and (e) to determine an average rate of change of longitudinal direction; and (g) processing the average rate of change of longitudinal direction determined in (f) to control the direction of drilling of the subterranean borehole.

14. The method of claim 7, wherein the surveying devices each comprise accelerometers.

* * * * *

UNITED STATES PATENT AND TRADEMARK OFFICE

CERTIFICATE OF CORRECTION

PATENT NO. : 7,584,788 B2
APPLICATION NO. : 11/805171
DATED : September 8, 2009
INVENTOR(S) : Emilio Baron and Stephen Jones It is certified that error appears in the above-identified patent and that said Letters Patent is hereby corrected as shown below:

Column 10, line 49, "a a curvature" should be changed to --a curvature--.

Signed and Sealed this

Twenty-seventh Day of April, 2010

David J. Kappos

David J. Kappos
*Director of the United States Patent and Trademark Office*